United States Patent [19]

Gudmundsson

[11] Patent Number: 4,885,852

[45] Date of Patent: Dec. 12, 1989

[54] SNOW REMOVAL APPARATUS AND METHOD

[76] Inventor: Bjoern J. Gudmundsson, 650 Laugar, S-Thing, Holabraut, Iceland

[21] Appl. No.: 76,626

[22] Filed: Jul. 23, 1987

[30] Foreign Application Priority Data

Jul. 23, 1986 [IS] Iceland ..... 3130

[51] Int. Cl.[4] ..... E01H 5/09

[52] U.S. Cl. ..... 37/260; 37/279

[58] Field of Search ..... 37/248, 260, 262, 202, 37/279, 280, 281, 283, 272, 274, 275, 277, 266, 227, 201

[56] References Cited

U.S. PATENT DOCUMENTS

| | | | |
|---|---|---|---|
| Re. 16,081 | 5/1925 | Connolly | 37/227 |
| 178,172 | 5/1876 | Mabbs | 37/202 |
| 947,121 | 1/1910 | McLain | 37/202 |
| 1,851,301 | 3/1932 | Bunnell | 37/260 |
| 2,160,973 | 6/1939 | Litchy | 37/275 |
| 2,222,437 | 11/1940 | Lykken | 37/266 |
| 2,404,287 | 7/1946 | Greer | 37/244 |
| 2,436,956 | 3/1948 | Dupras | 37/248 |
| 2,546,339 | 3/1951 | Greer | 37/227 |
| 2,904,904 | 9/1959 | Krueger | 37/275 |
| 2,936,537 | 5/1960 | Bain | 37/202 |
| 3,466,767 | 9/1969 | Rubin | 37/260 |
| 3,493,989 | 2/1970 | Karijo | 37/202 |

*Primary Examiner*—Eugene H. Eickholt
*Attorney, Agent, or Firm*—Richard C. Litman

[57] ABSTRACT

A method and apparatus for removing snow from roadways and the like includes the provision of a curved scraper blade having top and bottom edges and defining a generally circular passageway forward of the blade extending longitudinally the length of the blade. Forward movement of the blade causes the bottom edge to lift up snow from the roadway and as it is urged into the passageway, pressurized air from an air blower is expelled into the passageway, causing the snow therein to be expelled laterally of the scraper blade and over the roadside. The pressurized air may be expelled into the passageway through one or more apertures in the blade intermediate its ends or alternatively, through an aperture at either end of the blade. An extendible top blade on the scraper blade permits variation of the overall blade and passageway configuration to accommodate different snow conditions while the scraper blade is angularly displaceable about a central vertical axis to alter the lateral discharge path of expelled snow from the passageway.

8 Claims, 3 Drawing Sheets

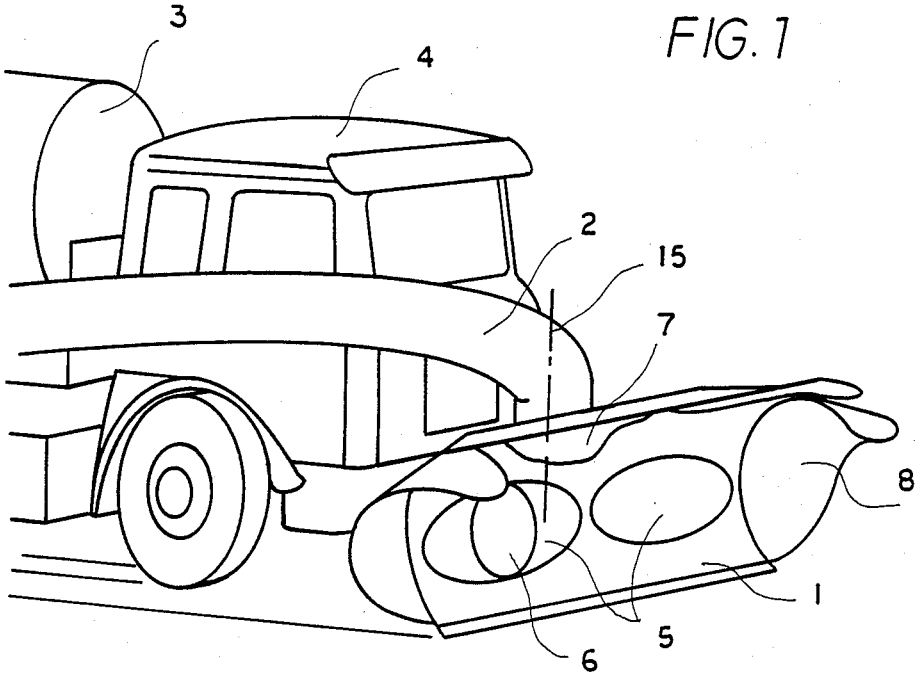
FIG. 1
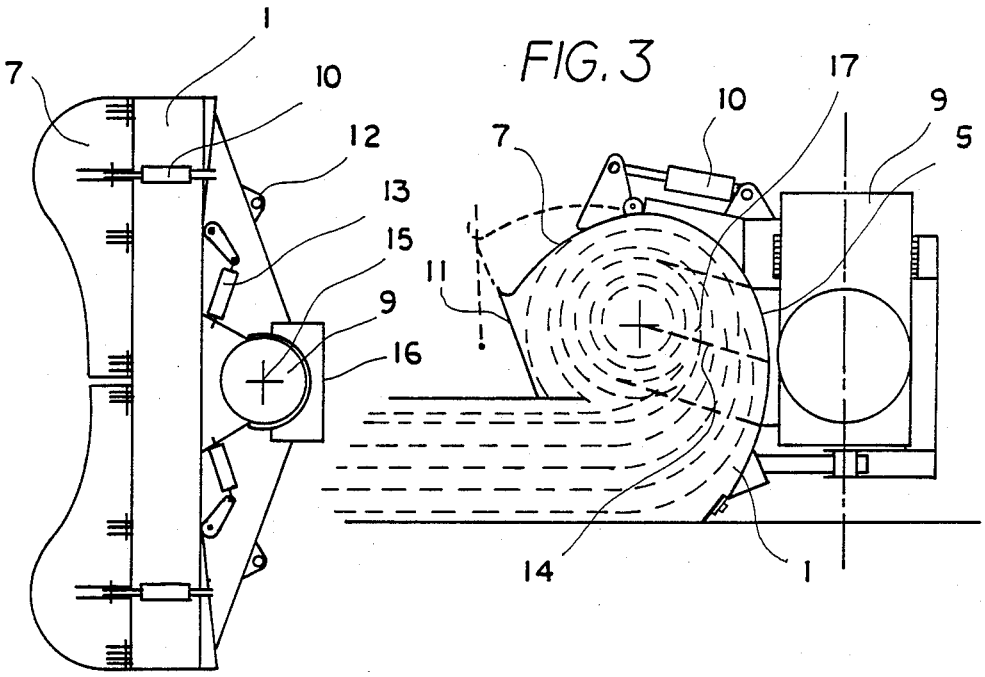
FIG. 3
FIG. 2

FIG. 4
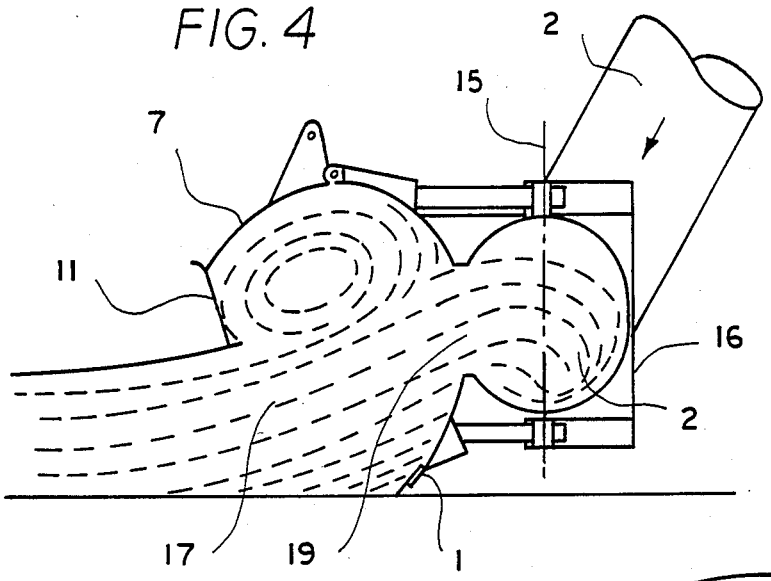
FIG. 5
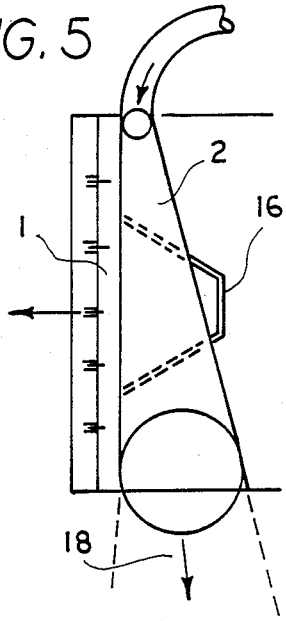
FIG. 6
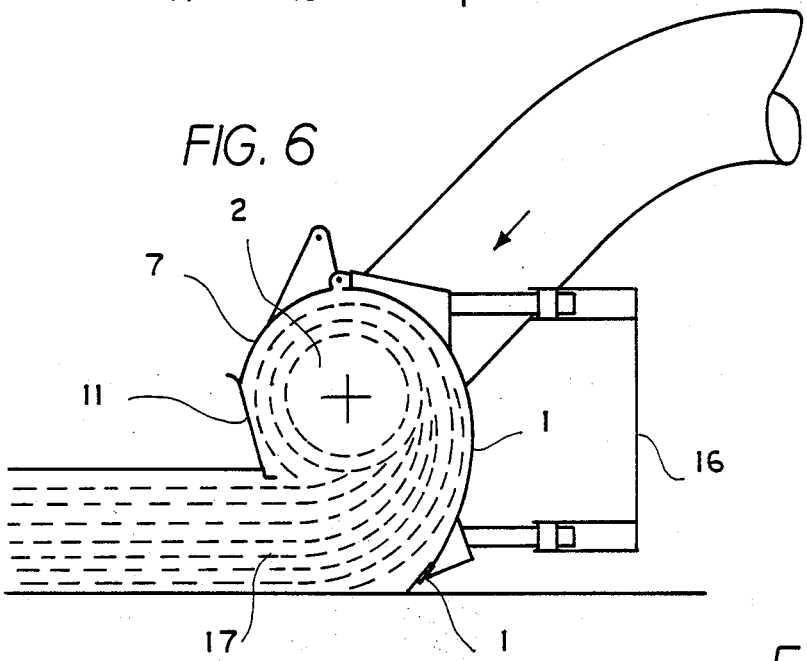
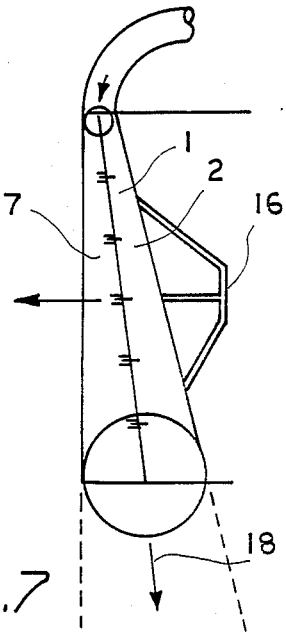
FIG. 7
FIG. 13
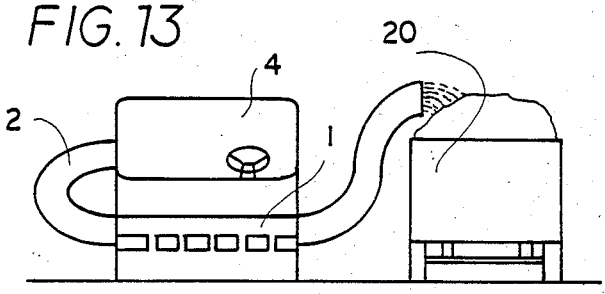

FIG. 8A
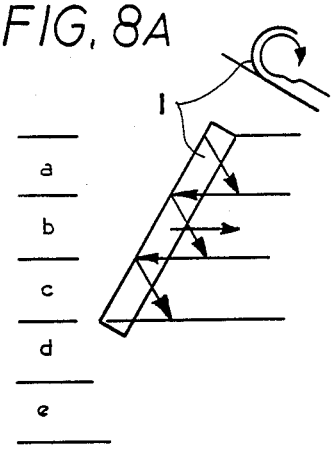
FIG. 8B
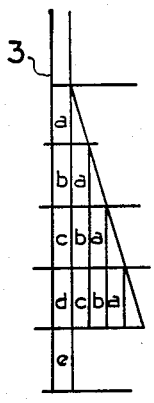
FIG. 8C
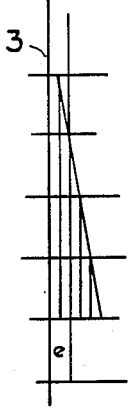
FIG. 8D
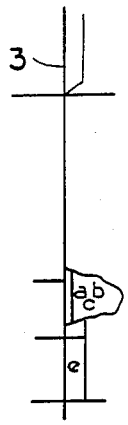
FIG. 9A
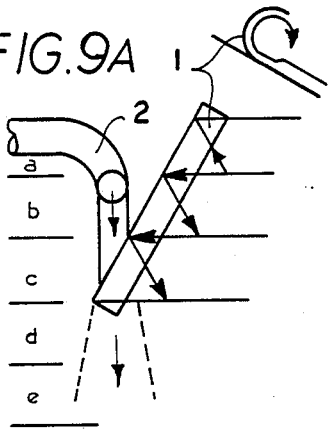
FIG. 9B
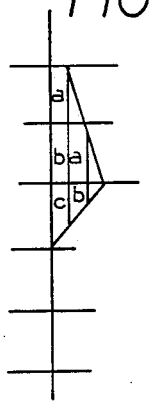
FIG. 9C
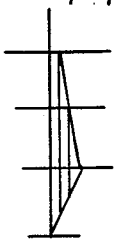
FIG. 9D
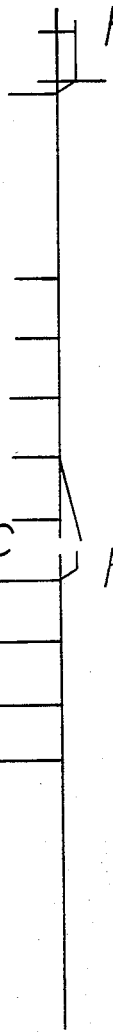
FIG. 10A
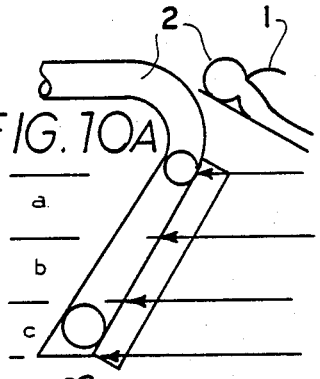
FIG. 10B
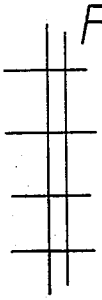
FIG. 10C
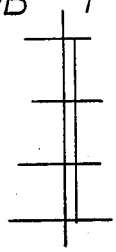
FIG. 10D
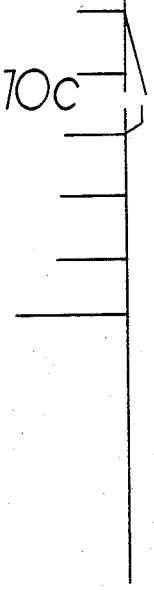
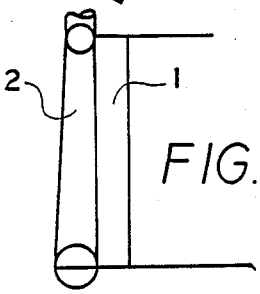
FIG. 11
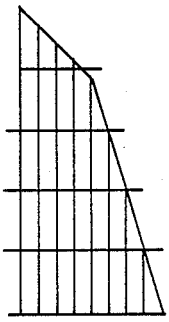
FIG. 12

SNOW REMOVAL APPARATUS AND METHOD

BACKGROUND OF THE INVENTION

1. FIELD OF THE INVENTION

This invention is directed to a method and equipment for removing and throwing away snow from a road. The method is to scrape the snow up from the road, lead it to a wind channel and to blow air along the wind channel in a direction away from the scraper and away from the road.

The snow remover includes an air blower and air channel from its pressure side to a hole or holes in the scraper blade or an air channel along the scraper on its rear and leading to conveying holes for the snow into that air channel, or an air channel along the scraper at its front, formed by the scraper and extending blades and flaps.

The snow removal equipment either moves the snow to one side, alternately to both sides, or to both sides at the same time. The scraper blade can be fixed, straight or plow formed, can be raised and lowered and can be inclinable. The blower is either powered by its own motor or powered by the motor of the associated vehicle, which can be a truck, a tractor, a heavy-duty universal tractor, a car, a jeep or a road planer or special snow removal equipment. Also to be considered are hand operated equipment, pushed forward similar to a lawn mower.

2. DESCRIPTION OF THE PRIOR ART

The most common snow removal equipment is a scraper, mounted on a heavy truck. The scraper lifts the snow up from the road. It is inclined and therefore at the same time snow is progressively pushed to one side, where it builds up as a ridge or a snowbank all along the road. This ridge causes much trouble. It is hindering to all vehicle traffic and encloses or blocks vehicles at the roadside whereafter they must be shoveled free. In a wind the snow is drifting over the ridge and down to the road and in such cases that snow must subsequently be removed along with the snow in the ridge too.

Scrapers are very effective and in an even snow they can be forced forward at a full speed of say 80 km/hr, if the road and conditions allow. Then the snow is thrown out over the roadside and does not form a ridge. Such conditions are very rare. Bad weather conditions, snowfall, unclear view, darkness, bends in the road, traffic, vehicles on the roadside, safety fences and other hindrances all limit the speed and the resultant loss of inertia leads to the unavoidable snow ridge.

Another common snow removal equipment is the snow blower. It does not include a scraper, but uses a spiral mechanism, which moves the snow to the middle point where the snow enters a centrifugal blower, which directly pumps it through and blows it upwards in a direction over the roadside. The snow blower is mainly used to remove snow ridges left by scrapers. It is ineffective and moves slowly. The typical speed is 1 to 3 km/hr and it effects 10 to 18 tons/min.

The third snow removal equipment is the snowplow, which is a plow-formed scraper, moving the snow to both sides and is mainly used on snowbanks, where the scraper is unable to get through. The plow is a much heavier apparatus than the scraper and made for greater impact and needs a high powered, heavy vehicle behind itself. With a sufficient speed (80 km/hr) the plow can throw the snow over the roadside and then no snow ridge is formed.

Thus various prior art snow removal equipment serve their own purpose in snow-removal. The plow works the snowbanks but is unnecessarily big and heavy for other situations. The snow blower is usable on ridges and snowbanks, but is slow and ineffective in other cases. The snow scrapers are most suitable for even snow, but they only remove sufficiently at full speed, where there are no hindrances, otherwise they leave ridges.

Bulldozers are not directly snow-removal equipment, but still are used for pushing away ridges and snowbanks. They move slowly but can move everything. Road planers can push snow ridges a little to one side and widen the free road but are otherwise only slow-moving scrapers. Powered shovels are able to shovel away snowbanks and ridges and when outfitted with scrapers they are slow-moving scrapers.

From this it should be clear, that there is a considerable need for snow removal equipment, which can remove snow at full speed, where conditions allow, and remove sufficiently at slow speed, when conditions do not allow greater speed. Also there is a considerable need for snow removal equipment, which can effectively operate with different hindrances on the roadside, for example cars, which have stuck in the snow and have been left behind, guardrails along the roadside, traffic signs, trees and such things, and generally all hindrances in areas, which are to be cleared or which snow ridges will cover. The purpose of the invention is to create such an equipment. Such equipment is capable of clearing the road at full speed when conditions allow and at slow speed without forming ridges and is capable of clearing stuck cars and hindrances of any kind, all without the necessity of other equipment.

SUMMARY OF THE INVENTION

The invention proposes expelling air at the scraper and blowing away the snow, which has been lifted by the scraper, without letting the snow enter into and go through the blower. The snow is 100 to 500 times as heavy as air and the blower depends on only the one specific weight and has low efficiency against the other. The invention presumes constructing the blower for air and transferring its kinetic energy onto the snow, where it is in floating form and in motion in relation to the scraper and therefore mixing the two components easily. It is remarkable, that a scraper can effect 25 $m^3$/sec. Snow removal equipment according to the invention can effect 25 $m^3$/sec of snow, does not form a ridge and thereby eliminates the snow blower, and clears around hindrances at the roadside and thereby performs in a manner which even the snow blower cannot and thus revolutionizes snow removal. The invention will now be described by means of the following figures.

BRIEF DESCRIPTION OF THE DRAWINGS

FIG. 1 shows a perspective view of the snow removal apparatus.

FIG. 2 shows a top view of the scraper with the air channel in the middle of the scraper blade.

FIG. 3 shows a side view of the scraper in cross-section.

FIG. 4 shows a side view of the scraper in cross-section with the air channel to the side and behind the scraper blade.

FIG. 5 shows a top view of the scraper of the previous drawing.

FIG. 6 shows a side view of the scraper in cross-section with the air channel in front of the scraper blade.

FIG. 7 shows a top view of the scraper in which the air channel is in front of the scraper blade.

FIG. 8*a* shows a top view of a conventional scraper blade.

FIG. 8*b* shows how snow moves along the conventional scraper blade.

FIG. 8*c* shows how snow compresses along a conventional scraper blade.

FIG. 8*d* shows the resultant path from a conventional scraper blade.

FIG. 9*a* shows a top view of a scraper blade having the air channel in the middle.

FIG. 9*b* shows how snow moves along the scraper blade shown in FIG. 9*a*.

FIG. 9*c* shows how snow compresses along the scraper blade shown in FIG. 9*a*.

FIG. 9*d* shows how snow compresses along the scraper blade shown in FIG. 9*a*.

FIG. 10*a* shows a top view of a scraper blade having the air channel expel the snow behind the scraper.

FIG. 10*b* shows how snow moves along the scraper blade shown in FIG. 10*a*.

FIG. 10*c* shows how snow compresses along the scraper blade shown in FIG. 10*a*.

FIG. 10*d* shows the resultant path from the scraper blades shown in FIG. 10*a*.

FIG. 11 shows a top view of a scraper blade having no inclination.

FIG. 12 shows the resulting pile of snow in section deposited to the side of the road.

FIG. 13 shows using transport equipment with the snow removal equipment.

Similar reference characters denote corresponding parts throughout the specification and drawings.

DESCRIPTION OF THE PREFERRED EMBODIMENT

FIG. 1 shows the scraper 1 comprising an arcuate, open front member adapted to be disposed generally transversely of the path of movement and which is connected to the conduit or air channel 2 powered by an air blower 3 on the vehicle 4, which is outfitted with standard fixtures for the scraper. The scraper 1 has laterally adjacent expelling air openings 5 therein provided with movable closing doors or blades 6 and is fitted with extendible blades or flaps 7 and 8 at the top and at the sides or ends, respectively. The scraper is inclinable around the axis 15 and is able to push and blow to right and to left.

FIG. 2 is a top view of the scraper showing adjustable top extendible blades 7 and closing blades 13. The air channel 9 is located around the inclination axis 15 adjacent the fixture mechanism 16 to the vehicle. 12 is an adjusting lug.

FIG. 3 is an end elevation view of the scraper. The extendible top blades 7 and the flaps 11 depending from the scraper blade are adjustable by the pistons 10. The air channel 9 opens through the scraper apertures 5 and the expelled air having a direction 14 impacts the snow 17, which is floating up from the scraper 1.

FIG. 4 shows the scraper 1 with the extendible blades 7 and the flaps 11 and with the inclination axis 15 and the mounting fixtures 16, where the air channel 2 is behind the scraper 1 and the snow 17 is floating through the channel apertures 19 from the scraper into the wind channel 2.

FIG. 5 is a top view of this type, where 18 is the expelled beam of snow and air. When the snow mixes into the air, the velocity is reduced and the volume increases and therefore the cross section of the air channel must increase accordingly.

FIG. 6 shows the scraper 1 with the extendible blades 7 and flaps 11, where the air channel is in front of the scraper blade or lower or rear portion, and the scraper blade 1, the extendible blades 7 and the flaps 11 are forming the air channel or limiting it outwardly.

FIG. 7 is a top view of this type. The scraper 1 and the extendible blades 7 are forming the air channel 2 and are forming the expelled beam 18. The snow is floating upwards along the scraper blade 1 and floats into the wind channel 2. The velocity of the expelled beam 18 becomes approximately a 1/9 part of the velocity of the unmixed air in the air channel 2 in the case of light-weight new snowfall and the same volume of snow and air. The velocity of the expelled air-beam becomes higher if the scraper 1 is inclined, and then the scraper is capable of throwing away even ice, although it does not mix into the expelling air.

If the scraper is stationary, there is no snow mixing into the wind channel 2 behind the scraper blade or in front of the scraper blade, and the velocity of the expelled air is reduced to a half, if the section of the wind channel is not reduced by means of the extendible blades 7. This velocity is sufficient to blow away uncompressed snow from hindrances on the roadside. On the contrary any air velocity is insufficient to blow away compacted snow. It must first be cut loose. On the road, that is the purpose of the scraper, but where the scraper cannot reach, the airstream is strongest from the apertures 5 in the scraper blade 1 of FIG. 1. On the contrary a full pressure from the blower can be utilized through a special nozzle, whose only purpose is to clear snow from stationary objects. FIG. 7 is a top view of the scraper of FIG. 6. The scrapers of FIGS. 5 and 7 are most suitable if inclinable or inclined. In an inclined position a part of the kinetic energy of the snow is utilized for expelling and the expelling velocity is increased but the width of the cleared path is reduce.

In FIGS. 8*b*, 9*b*, and 10*b* an attempt is made to display visually the resistance in front of the scraper, and in FIGS. 8*d*, 9*d*, and 10*d* a section in the cleared path and snow ridges. FIGS. 8*a*, 9*a*, and 10*a* display the scraper types, FIGS. 8*b*, 9*b*, and 10*b* show how the snow from the paths a, b and c is moving along the scraper blade, in FIGS. 8*c*, 9*c*, and 10*c* show the snow compressed and in FIGS. 8*d*, 9*d* and 10*d* a section of the cleared path and snow ridges. FIG. 12 displays the volume of snow in section, which is opposite the expelled beam for the clearing of the roadside, outside the road.

FIG. 8*a* displays a conventional scraper, where the same snow up to 4 times meets the scraper, which each time throws the snow forward with a velocity of double the velocity of the vehicle, and where the scraper generally has a 2:5 fold depth of snow in front of itself, in relation to the snow in front. This requires a high force from the vehicle.

FIG. 10*a* displays the type, where the expelled air is behind the scraper. The scraper is not pushing any volume forwards, but is lifting the snow upwards approximately the depth of the snow and then the expelling air takes care of throwing the snow away. The snow is not propelled forwards and therefore almost no force is needed from the vehicle. Therefore these scrapers can be proportionally wider.

A scraper according to FIGS. 1, 2 and 3 is displayed in FIG. 9*a*. It pushes forward approximately half the volume of the conventional scraper according to FIG. 8*a* and therefore needs one-half of its force and has high expelling force sidewards outside the road, because the nozzle is near to the roadside and exerts a great velocity. On the other hand the snow is compressed at the nozzle and develops clumps and therefore does not mix into the air as well as with equipment according to FIG. 10*a*, where the snow is almost uncompressed.

Equipment according to FIGS. 6 and 7 is not displayed on these comparing figures wherein that equipment pushes the snow forwards in front of itself one turn and then it is expelled away.

Thus the invention includes three new methods in addition to the method of the conventional scraper. Each method has its own characteristics, needs its own vehicle force and is treating the snow in its own way, can clear its own width, has its own bulk, but common to all of them is that they do not form ridges, are effective at any velocity and are friendly against the vehicle, where conventional scrapers are very demanding. Existing vehicles are heavy trucks carrying full load for providing weight and frictional force against the snow, and their motors are propelling at full power, conventionally 20 tons at the highest speed allowed, which is 80 km/hr. Equipment according to the invention can be forced by the smallest trucks or small pickups, only loaded by the blower and its motor and weighting totally approximately 4 tons. Snow removal costs are even to the costs of the vehicle and the costs of the motor of the blower and totals only to hardly one-half of the previous expenses. It may be mentioned, that the most suitable motor for the blower is a motor from a usual truck, and blowers are inexpensive gear. Cutting the costs to one-half is quite a revolution.

FIG. 11 displays a scraper according to the invention having no inclination.

FIG. 12 shows snow removal equipment according to the invention intended for also lifting the snow upon associated transport equipment, for example a big wagon, for transporting away. This type is suitable in towns and densely populated areas, where the snow must be transported away. This has usually been done by first scraping into snow ridges and then lifting the snow with a shovel or a snow blower upon a transport wagon. Equipment according to the invention takes care of this in one operation. by cleaning up with scraping and lifting directly upon a wagon.

The wind channel behind the scraper has in each section an area according to the volume and speed passing through. The same applies to the scraper blade, when the wind channel is on the front side.

The invention can be used for V-formed snowplows to make channels through large snowbanks. There is a hole for expelling air in the center with the beam directed to both sides, and in front of the hole there is a coverplate which prevents the snow from entering the opening. The opening is uppermost in the blade and the direction of the expelling beam is almost horizontal along the blade.

When the vehicle is a truck, it is suitable to propel the blower by its own motor, both mounted on the same framework, which can be lifted upon the platform and then connecting the air channel to the blower and the scraper. The air channel must always be flexible, so that the scraper can be lifted and inclined.

When the vehicle is a tractor, it is suitable to propel the blower by the power shaft and connect the blower thereto by a link.

A blower connected to a motor can be mounted upon a frame on wheels and trailed by any vehicle, and the scraper can be connected to the frame or bumper support. The scraper is subjected to only a small force from the snow, because the blade only cuts the carpet of snow from the surface, but does not compress the snow as before.

A small motored blower can be mounted upon a wheeled frame powered forward and steered by hand like a lawn mower. This is possible because of the small force from the snow. This is not possible by the old pushing method, because there is needed a weight and a driving force to build up a pressure against the snow and push it to the side out of the road. This is what the expelling air takes care of according to the invention.

Equipment according to the invention can be mounted upon a usual road planer, and equipment for special use can also be provided.

Regarding excavators and similar machinery on wheels it is suitable to propel the blower by its own motor and mount the blower and motor upon the main frame. An existing motor is always an advantage, because vehicle and blower are running at different revolutions and a power shaft and drive belt are often difficult to adapt.

In towns and villages the snow must be transported away. According to the invention this is done by means of an exhaust channel similar to the usual snow blowers. The channel is directed upwards and is directing the snow onto a truck's platform beside the vehicle or behind it. With such, there is a low speed and output accordingly.

What is claimed is:

1. Snow removal apparatus for a vehicle to remove snow from a roadway or the like comprising:

a forwardly curved scraper blade having top and bottom edges and defining a generally circular in cross-section passageway within the confines of said curved blade;

said passageway extending longitudinally the length of said blade;

an air blower operable to provide a positive expelling of air pressure; and an aerodynamic air channel communicating between said air blower and scraper blade passageway; said air channel having a gradually changing cross section, said air channel thereby allowing flow of said air and preserving the kinetic energy of said air; whereby positive air pressure produced upon operation of said air blower is directed horizontally to the ground and at an angle forward to one side of said blade, into said passageway so that during forward movement as said blade bottom edge lifts snow upward from a roadway and the snow enters said passageway and is entrained within, expelling air therein and subsequently expelling from said passageway with the expelling air conveying the snow from an end of said blade passageway laterally over the roadside, said scraper blade includes at least one aperture therethrough spaced from the ends thereof; said aperture having a cross section substantially as large as the cross section of said air channel and said air channel joined to said blade about said aperture.

2. Snow removal apparatus according to claim 1 including:

a closable door mounted adjacent an aperture spaced through said scraper blade said air channel joined to said blade about said aperture.

3. Snow removal apparatus for a vehicle to remove snow from a roadway or the like comprising:

a forwardly curved scraper blade having top and bottom edges and defining a generally circular in cross-section passageway within the confines of said curved blade;

said passageway extending longitudinally the length of said blade;

an air blower operable to provide a positive expelling of air pressure; and an air channel communicating between said blower and said scraper blade passageway;

an extendable blade hingedly joined to said scraper blade top edge; and displacable piston means connected to said extendable blade and operable to vary the size and cross-sectional configuration of said passageway;

whereby positive air pressure produced upon operation of said air blower is directed into said passageway so that during forward movement as said blade bottom edge lifts snow upward from a roadway and the snow enters said passageway and is entrained within said passageway, air is expelled therein, and subsequently expelled from said passageway with the expelling air conveying the snow from an end of said blade passageway laterally over the roadside.

4. Snow removal apparatus according to Claim 3 wherein:

said scraper blade includes an end flap at an end thereof;

said end flap including an aperture therethrough; and said air channel jointed to said blade about said aperture.

5. Snow removal apparatus according to Claim 3 including:

an elastic flap extending from said extendable blade.

6. Snow removal apparatus according to claim 3 wherein:

said scraper blade is mounted in front of a truck.

7. Snow removal apparatus according to claim 4 including:

a snow exhaust channel connected to an end of said blade passageway opposite said end flap and communicating with a separate transport-wagon to receive snow as expelled through said exhaust channel.

8. Snow removal apparatus for a vehicle to remove snow from a roadway or the like comprising:

a forwardly curved scraper blade having top and bottom edges and defining a generally circular in cross-section passageway within the confines of said curved blade;

said passageway extending longitudinally the length of said blade;

an air blower operable to provide a positive expelling of air pressure; and an air channel communicating between said blower and said scraper blade passageway;

said scraper blade includes an aperture therethrough spaced from the ends thereof; said aperture having a cross section substantially as large as the cross section of said air channel said air channel joined to said blade about said aperture;

a closable door mounted adjacent said aperture;

a central, vertical pivot axis for said scraper blade;

said blade angularly displaceable to either side about said pivot axis;

at least one said aperture through said blade to either side of said pivot axis; and said air channel communicating with all said apertures;

whereby positive air pressure produced upon operation of said air blower is directed into said passageway so that during forward movement as said blade bottom edge lifts snow upward from a roadway and the snow enters said passageway and is entrained within said passageway, air is expelled therein, and subsequently expelled from said passageway with the expelling air conveying the snow from an end of said blade passage way laterally over the roadside.

* * * * *